US012006596B2

(12) United States Patent
Muijsers

(10) Patent No.: US 12,006,596 B2
(45) Date of Patent: Jun. 11, 2024

(54) KAPOK FIBRE SPINNING PROCESS

(71) Applicant: FLOCUS B.V., Enschede (NL)

(72) Inventor: Jeroen J. Muijsers, Enschede (NL)

(73) Assignee: FLOCUS B.V., Enschede (NL)

( * ) Notice: Subject to any disclaimer, the term of this patent is extended or adjusted under 35 U.S.C. 154(b) by 387 days.

(21) Appl. No.: 17/296,799

(22) PCT Filed: Nov. 27, 2019

(86) PCT No.: PCT/NL2019/050785
§ 371 (c)(1),
(2) Date: May 25, 2021

(87) PCT Pub. No.: WO2020/111940
PCT Pub. Date: Jun. 4, 2020

(65) Prior Publication Data

US 2022/0025555 A1 Jan. 27, 2022

(30) Foreign Application Priority Data

Nov. 27, 2018 (NL) ..... 2022081

(51) Int. Cl.
*D01G 13/00* (2006.01)
*D01G 5/00* (2006.01)
*D04H 1/425* (2012.01)

(52) U.S. Cl.
CPC ..... *D01G 13/00* (2013.01); *D01G 5/00* (2013.01); *D04H 1/425* (2013.01)

(58) Field of Classification Search
CPC ..... D01G 5/00; D01G 13/00; D04H 1/425
See application file for complete search history.

(56) References Cited

U.S. PATENT DOCUMENTS 2,142,160 A * 1/1939 Swoyer ..... D02G 3/00 57/313
2007/0077423 A1 4/2007 Yan
2007/0283676 A1* 12/2007 Li ..... D01G 21/00 57/207

FOREIGN PATENT DOCUMENTS

CN 101008118 A * 8/2007
CN 101871148 A 10/2010
CN 104452102 A 3/2015
CN 107641871 A * 1/2018
CN 107641871 A 1/2018
DE 4030172 A1 3/1992
EP 1867763 A2 12/2007
GB 519943 A 4/1940
JP 2010012421 A 1/2010
KR 20090054265 A * 5/2009
KR 20090083820 A * 8/2009
KR 20120002199 * 1/2012
KR 20130094622 A 8/2013
KR 101450655 B1 * 10/2014
WO 2010012734 A2 2/2010

OTHER PUBLICATIONS

Database WPI Thomson Scientific, London, GB; vol. 2011, No. 29, AN 2010-P71386.
Database WPI Thomson Scientific, London, GB; vol. 2013, No. 62, AN 2013-N01911.
Database WPI Thomson Scientific, London, GB; vol. 2015, No. 35, AN 2015-296825.
Database WPI Thomson Scientific, London, GB; vol. 2018, No. 16, AN 2018-116333.
Zheng et al. "GB 9994—Conventional moisture regains of textiles (Draft for Approval)." National Standard of the People's Republic of China. Retrieved from the internet: https://members.wto.org/crnattachments/2015/TBT/CHN/15_4603_00_et.pdf [retrieved on Apr. 21, 2021]: pp. 1-10 (2015).
"New Technology Warp Sizing Lubricant is Introduced to the Textile Industry" Calgati Chemical Company Ltd., URL: https://www.textileweb.com/doc/new-technology-warp-sizing-lubricant-is-intro-0003; pp. 1-2 (2023).

* cited by examiner

*Primary Examiner* — Shaun R Hurley
(74) *Attorney, Agent, or Firm* — NIXON PEABODY LLP; Ronald I. Eisenstein; Nicole D. Kling

(57) ABSTRACT

The present invention relates to a process for obtaining a spinnable and/or needlable Kapok fibre fraction, and/or Kapok fibre blend with one or more other fibres in a range of from 100% to 10% by weight, comprising the steps of: •a. sorting the longest and cleanest fibres for spinning, by subjecting the fibres to an air stream directed towards a deposition area with a sorting wall, whereby a longer fibre fraction is collected behind the sorting wall, to obtain a short staple Kapok fibre base having an average length of from 10 to 20 mm; •b. adjusting the average moisture content of the kapok fibre base to an average measured moisture content in the range of from 8% to 12% moisture, to obtain moisture- and length-adjusted Kapok fibres, and, optionally •c. blending the moisture-and length-adjusted Kapok fibres with the second fibre base, to obtain a Kapok-comprising fibre blend.

30 Claims, No Drawings

KAPOK FIBRE SPINNING PROCESS

CROSS-REFERENCE TO RELATED APPLICATIONS

This application is a 35 U.S.C. § 371 National Phase Entry Application of International Application No. PCT/NL2019/050785 filed Nov. 27, 2019, which claims benefit under 35 U.S.C. 119(a) of NL Application Nos. 2022081 filed Nov. 27, 2018, the contents of which are incorporated herein by reference in their entireties.

FIELD OF THE INVENTION

The present invention relates to a multi-fibre blending and spinning process, and to the manufacture of yarns and fillings with high kapok fibre content.

BACKGROUND OF THE INVENTION

Kapok fibres are the seed hairs of the kapok tree, *Ceiba pentandra* and closely related species. The fibres are present in the fruit with the seeds, where they serve to distribute the seeds widely once the fruit capsules have dried off and have opened up, to expose the seeds and fibres. For industrial purposes, the fruits are harvested, and the seeds are removed. Kapok fibres are smooth, relatively short fibres, comprising a thin, cellulosic cell wall enclosing a comparatively large lumen, and are thus of a very low density. Kapok fibres are thus light, hollow, resilient, resistant to water. Due to a natural waxy coating and the high surface are, they are also highly combustible. In addition to the hydrophobicity, kapok fibres show excellent heat insulation and sound absorption properties.

Kapok fibres are in many aspects similar to cotton fibres, but much shorter and lighter: the length of the kapok fibres ranges from 18-27 mm, whereas the outer diameter of the fibre cross-section is 16.5 μm on average, and the diameter of the fibre lumen is 14.5 μm. Kapok fibres are thus about 5 times lighter than cotton, 4.5 times lighter than polyester, and similar to Down in density, and are among the finest naturally occurring microfibres.

As a renewable natural plant fibre, kapok fibre is abundant, biocompatible and biodegradable, and its full exploration and accordingly, it would be highly desirable to use the fibres in other applications, in particular yarns, and woven, or non-woven fabrics.

However, due to the shortness and low density, Kapok fibres are difficult, if almost impossible to spin, are irritant and represent a fire hazard, and have thus mainly been used as an alternative to down as filling in mattresses, pillows, upholstery, safety vests, and stuffed toys such as teddy bears, and for insulation purposes in general.

Not only has spinning into yarns with a kapok fibre content of more than 50% has proven difficult, the presence of lower amounts of Kapok has also resulted in yarn breakage, fluff. Even when used in a small admixture, the yarns are often not homogenous, and exhibit low fracture strengths, a high breakage number and many other yarn defects, rendering it neigh impossible to process kapok fibres into yarns, whether alone or in combinations. Also, the fibre blending has been proved difficult, and thus far, no blend ratios above 50% have been reported on an industrial process scale.

SUMMARY OF THE INVENTION

Accordingly, the present invention relates to a process for obtaining a spinnable and/or needable Kapok fibre fraction, and/or Kapok fibre blend with one or more other fibres in a range of from 100% to 5% by weight, comprising the steps of:

a. sorting the longest and cleanest kapok fibres for spinning, which comprises volatizing opened and unsorted Kapok fibres by subjecting them to an air stream, whereby the fibre-containing air stream is directed towards a deposition area comprising a sorting wall, whereby fibres of different lengths are deposited in the deposition area and/or against the sorting wall at a position commensurate with their length, weight and the resulting respective flight time, whereby a longer fibre fraction is collected behind the sorting wall, to obtain a short staple Kapok fibre base having an average length of at least 10 mm;

b. adjusting the average moisture content of the kapok fibre base (to an average measured moisture content in the range of from 8% to 12% moisture, to obtain moisture- and length-adjusted Kapok fibres, and, optionally c. blending the moisture-and length-adjusted Kapok fibres with a second or further fibre base, to obtain a Kapok-comprising fibre blend. In a second aspect, the present invention relates to a yarn comprising 50% by weight or more of Kapok fibres, and preferably, at last a second fibre.

In a third aspect, the present invention relates to a fabric comprising the yarn according to the invention.

In a fourth aspect, the present invention relates to a process for preparing a non-woven material, comprising a step to convert the moisture- and length-adjusted Kapok fibres, or the Kapok-comprising fibre blend into a batt, needling the batt of blended fibres, and subjecting the needled batt of fibres with a suitable sizing, and/or placing the needled batt into a scrim.

In a fifth aspect, the present invention relates to a shaped article comprising a fabric and/or a non-woven material according to the invention.

DETAILED DESCRIPTION OF THE INVENTION

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the articles "a" and "an" preceding an element or component are intended to be non-restrictive regarding the number of instances (i.e. occurrences) of the element or component. Therefore, "a" or "an" should be read to include one or at least one, and the singular word form of the element or component also includes the plural unless the number is obviously meant to be singular.

As used herein, the terms "invention" or "present invention" are non-limiting terms and not intended to refer to any single aspect of the particular invention but encompass all possible aspects as described in the specification and the claims.

As used herein, the term "about" modifying the quantity of an ingredient, component, or reactant of the invention employed refers to variation in the numerical quantity that can occur, for example, through typical measuring and liquid handling procedures used for making concentrates or solutions in the real world. Furthermore, variation can occur from inadvertent error in measuring procedures, differences in the manufacture, source, or purity of the ingredients employed to make the compositions or carry out the methods, and the like. Whether or not modified by the term "about," the claims include equivalents to the quantities. In one aspect, the term "about" means within 10% of the reported numerical value. In another aspect, "about" means within 5% of the reported numerical value.

As used herein, the terms "percent by weight," "% by weight," and "wt. %" mean the weight of a pure substance divided by the total dry weight of a compound or composition, multiplied by 100. Typically, "weight" is measured in grams (g). For example, a composition with a total weight of 100 grams, which includes 25 grams of substance A, will include substance A in 25% by weight.

As used herein, the terms "nonwoven" means a web or fabric having a structure of individual fibres which are randomly interlaid, but not in an identifiable manner as is the case of a knitted or woven fabric. The brightened fibres in accordance with the present invention can be employed to prepare nonwoven structures and textiles.

As used herein, the term "natural fibres" means fibres produced by and extracted from a plant or animal, the exception that such fibres do not include wood fibres, i.e., derived from a tree, and man-made fibres formed from cellulose, e.g. viscose. Non-limiting examples of suitable natural fibres are plant-based fibres, such as bast fibres, including, but are not limited to, flax fibres, hemp fibres, jute fibres, ramie fibres, nettle fibres, Spanish broom fibres, kenaf plant fibres, or any combination thereof.

Natural fibres include seed hair fibres, for example, cotton fibres. Natural fibres may also include animal fibres, for example, wool, goat hair, human hair, silk fibres and the like.

The present invention advantageously also relates to yarns or fibre compositions comprising Kapok combined with combed and/or carded cotton; advantageously BCI cotton or long staple cotton; Kapok with polyesters; kapok with nylon; Kapok with fiber dyed synthetic or natural fibers; Kapok with viscose, lyocell, modal or bamboo fibres; as well as combinations of 3 r more fibres, such as Kapok with lyocell and cotton; Kapok with lyocell and synthetic fibres such as polyesters; or Kapok with lyocell and HTPE and/or other synthetic fibres. Insulations blends of non-woven materials preferably comprise 100% kapok needling; Kapok with Synthetic fibres, such as polyesters, more particularly recycled polyesters or low melt polyesters; Kapok and wool fibres; Kapok and Tencel; Kapok and silk; and Kapok—wool—Polylactic acid.

The subject process comprises a number of steps, including sorting of the fibres to increase the average staple length for the bale for spinning fibres, and also to reduce the contamination per bale; adjusting the moisture content of the thus selected fibres before spinning them into yarn with a high content of kapok, while still having sufficient break strength for use in fabric production. The process according of the present invention comprises sorting of the kapok fibres to select the longest, and preferably cleanest fibres for spinning, and spinning with this selected short staple comprising fibres ranging of from 10 to 20 mm Preferably, in the present process step (a) comprises volatizing opened and unsorted Kapok fibres by subjecting them to an air stream, whereby the fibre-containing air stream is directed towards a deposition area comprising a sorting wall, whereby fibres of different lengths are deposited in the deposition area and/or against the sorting wall at a position commensurate with their length, weight and the resulting respective flight time, whereby a longer fibre fraction is collected behind the sorting wall.

Advantageously, the sorting wall is based at an angle essentially perpendicular to the air stream, and at a distance and with a height suitable to obtain a kapok fibre fraction comprising fibres of at least 10 mm length.

A further key step includes subjecting the kapok fibres or the sorted kapok fibres to conditions that increase the fibre moisture content, thereby rendering them heavier, but not wet, as otherwise the wet fibres will stick to the machines in the later process. Once the kapok fibres have attained the desired moisture content, they may then be blended with other fibres. Accordingly, the moisture content and hence density is chosen accordingly to the second (or more) fibre density.

This permits to prepare yarns and blends of kapok fibres with natural and/or artificially made fibres into yarns with hitherto unreported kapok content, thereby creating in unique blends.

Preferably, a twist is applied depending on the yarn counts, and the percentage of kapok fibres present. Preferred are yarns with false or low twist, however a higher twist may be applied of so desired.

Typical kapok fibres contain about 35-50% a-cellulose, 22-45% hemicellulose, 15 to 22% lignin content; 22% xylan and of from 10 to 15% of acetyl groups, all by weight, and 10 to 11% of moisture, and 2 to 3% of waxes. The chemical property of kapok fibres are similar to those of hemp and jute as a lignocellulose fibre. Compared to cotton, kapok fibres are stiffer, have a lower extensibility and are more brittle. Besides the short staple length of kapok fibres, the smooth and very regular surface structure also make spinning of the fibres difficult, since the fibres are more slippery and difficult to grip.

The present process may preferably also further comprise the step of d. teasing and/or carding the moisture- and length-adjusted Kapok fibres, or the Kapok-comprising fibre blend, to obtain Kapok-comprising carded fibres; e. optionally roving the carded fibres, and f. spinning the carded fibres, or the rovings, into a yarn.

Preferably the process also further comprises the steps of a. drafting a roving of the kapok-comprising fibre blend to a thinner fibre strand; b. optionally twisting the strand, and c. winding the strand or twisted strand as a yarn to a wound yarn bobbin. Sizing: Preferably, a coating or sizing may be employed to make the yarn run smoother in knitting and weaving. Applicants surprisingly found that typical paraffin emulsion coatings employed for instance for cotton fibres, and at typical concentrations were unable to cover the short fibres, and hence failed to increase the yarn smoothness sufficiently to allow for knitting.

Contrarily, use of a solid wax sizing, preferably a natural wax solid at room temperature permitted reduction of the amount of flying or loose fibres coming out of the yarn, resulting in less issues with blocked machines, and hence less downtime and machine cleaning was required. Beneficially, the obtained reduction in airborne fibres of kapok was found to reduce contamination issues to other machines in the facility, and potential exposure of workers in the spinning facility. Accordingly, and advantageously, the present process comprises sizing the fibre strand or yarn with a sizing agent, preferably wherein the sizing agent comprises a wax, preferably a solid natural wax. The sizing then comprises contacting the fibre strand or yarn with the wax.

Carding:

Carding herein refers to a mechanical process that disentangles, cleans and intermixes fibres to produce a continuous web or sliver suitable for subsequent processing, by passing the fibres between differentially moving surfaces covered with card clothing, to breaks up locks and unorganised clumps of fibre and then aligning the individual fibres to be parallel with each other. Card clothing herein refers to a sturdy flexible backing in which closely spaced wire pins are embedded. Shape, length, diameter, and spacing of these wire pins may be adapted to the particular requirements of the application, and may include metallic card clothing.

Suitable Blending fibres:One or more secondary and/or tertiary fibres employed in the process may preferably comprise one or more of naturally occurring, treated naturally occurring fibres, or synthetic fibres, preferably obtained by extrusion spinning, wet spinning, and/or melt spinning. The one or more synthetic fibres may include polyamides, such as nylon; polyacrylic fibres, polyolefinic fibres; polyester fibres; and/or cellulosic fibres such as Rayon, Tencell or Lyocell.

These one or more fibres may preferably be employed in an amount of from 0 to 95% by weight. Such materials may be virgin materials, recycled materials, or combinations thereof.

Generally, useful synthetic fibres include polyamides, such as nylon; acrylic, olefinic, and/or polyester fibres cellulosic fibres such as rayon or lyocell. Suitable polyesters may include aliphatic, semi-aromatic or aromatic polyesters, and may be virgin materials, recycled materials, or combinations thereof. Any process that is suitable to prepare a clean even staple is obtained may be employed for the preparation of such fibres. Preferred polyester fibres may include aliphatic, semi-aromatic or aromatic polyester materials as virgin materials, recycled materials, or combinations thereof.

The one or more naturally occurring fibres may be obtained from animal sources, such as wool from sheep, goat, alpaca, and/or rabbit, silk threads from silkworms, or from plant sources, such as cotton, flax, hemp, jute, sisal, bamboo, milkweed or the like. More preferably, the one or more natural fibres are present in an amount of from 0 to 95% by weight, depending on the desired properties.

Preferably, tertiary mixtures may be employed as well where so desired, combining properties of the various fibres. Useful plant derived fibres may preferably comprise those derived from seed capsules such as cotton or milkweed, or baste fibres, such as flax, hemp, jute, or leaf fibres, such as sisal.

Applicants found that the present process is particularly useful to blend other fibres with kapok fibres in a range of from 5% -100%, i.e. 5% kapok to 100% kapok, Preferably, the present process is particularly useful to blend other fibres with kapok fibres, wherein the content of kapok fibres to one or more other fibres is at least 5%, more preferably at least 10%, yet more preferably at least 15%, yet more preferably at least 20%, more preferably at least 25%, yet more preferably at least 30%, 31%, 35%, 40%, 45%, 50%, 55%, 58%, 60% of kapok on the one or more other fibres.

Preferably for yarns, kapok fibre contents above 30% are used for thicker yarns, whereas at lower concentrations, thinner yarns may be advantageously be prepared.

Preferred non-kapok to kapok yarn fibre ratios range from 20%-75%, more preferably of from 30 to 65%, yet more preferably of from 40-50%. Where one or more other fibres are employed, weight ratios of from 5-95% for the other fibres may advantageously be employed, preferably using 20% or less kapok fibres for thinner yarn counts, whereas for thicker counts higher amounts of Kapok may be applied, such as up to 60%.

Suitable Spinning methods: Spinning herein refers to the twisting together of drawn-out strands of fibres to form yarn, including any suitable conventional processes available to spin yarn, such as spinning techniques where the fibre is drawn out, twisted, and wound onto a bobbin. For staple yards, methods such as vortex spinning, wool spinning, worsted spinning; ring spinning, core-spun spinning; open end spinning, multi-component spinning such as siro spinning, compact spinning; friction twisting, self-twist spinning, electrostatic, and twistless spinning may be applied. The latter typically include the use of staple fibre spinning process machines, which is highly preferred.

All spinning frames may be employed, including ring spinning, open-end (rotor) spinning, and air-jet spinning. With the common ring spinner, the lengthened yarn is fed onto a bobbin or spool on a rotating spindle. The winding is controlled by a traveler feed that moves on a ring around the spindle but at a slower speed than that of the spindle. The result is a twisting of the yarn. The yarn guide oscillates axially during winding to distribute the yarn neatly on the bobbin. The yarn can then be used to weave or knit textile fabrics or to make a thread, cord or rope. Staple yarns, made from shorter fibres require usually more twist to provide a sufficiently strong yarn, whereas filaments have less need to be tightly twisted.

For integrated composite spinning, following methods may preferably be employed: cover spinning, selfil yarn spinning and acro dynamic spinning. For spinning filament yarn, the following methods may be employed: wet spinning, dry spinning, melt spinning, bi-component spinning, film splitting reaction spinning. Accordingly, spinning may preferably include the following, well-known processes: vortex spinning, wool spinning, worsted spinning; ring spinning, open end spinning, multi-component spinning such as siro spinning, compact spinning; friction twisting, self-twist spinning, electrostatic, and twistless spinning.

Suitable yarns comprising 16% by weight or more of Kapok fibres, may preferably have a Count-related yarn tenacity of above 7, and a Single Yarn Strength and Elongation with CV % pursuant to as determined by ASTM D2256-10(2015) of above 5.95. The yarn may further be converted into a woven or non-woven fabric.

The present invention also relates to fabrics comprising the yarn according to the invention.

Needling: The present invention also relates to a process convert the moisture- and length-adjusted Kapok fibres, or the Kapok-comprising fibre blend into a padding or insulation material. This may include converting the moisture- and length-adjusted Kapok fibres, or the Kapok-comprising fibre blend into a batt, needling the batt of blended fibres, and subjecting the needled batt of fibres with a suitable sizing, and/or placing the needled batt into a scrim, or fixing the fibres with a low melt material.

Preferably, this further comprises a step to convert the moisture- and length-adjusted Kapok fibres, or the Kapok-comprising fibre blend into a batt, crosslapping (layering) the batt of blended fibres, and subjecting the cross-lapped batt of fibres with a suitable sizing, and/or placing the needled batt into a scrim. Preferably, low melt fusible fibres may be added to the moisture and length adapted Kapok fibres, forming the blend into a batt, needling the batt of blended fibres, subjecting the needled batt of fibres to a temperature above the melting temperature of the low melt fusible fibres for a period of time sufficient to form a cohesive composite non-woven fabric, and treating the composite non-woven fabric during a cooling down step to provide flexibility.

The present invention also relates to a non-woven material obtainable according to the subject process, and to a shaped article comprising a fabric obtainable thereby For insulation, filling and/or padding materials, suitable machines for the preparation of fillings include cross-lapping (layering) and needling machines, wherein the later were particularly useful. Scrims or resin finishes may be applied or used to increase the structural integrity of the fillings during washing, and to reduce lose flying fibres during sewing and adds more stability in logistics.

Suitable natural fibres are from usually animal, ie sheep, goat, rabbit, silkworm sources, from minerals (such as asbestos), or plants (cotton, flax, sisal). The vegetable fibres can come from the seed (cotton), the stem (known as baste fibres: flax, hemp, jute) or the leaf (sisal).

Artificial fibres useful to be blended with the Kapok fibres are usually made by extruding a polymer through a spinneret into a medium where it hardens, such as wet spinning of rayon, which uses a coagulating medium. Dry spinning of acetate and triacetate fibres refers to process wherein a polymer contained in a solvent is passed through a heated exit chamber whereby the solvent evaporates. In melt spinning, of e.g. nylons and polyesters, an extruded polymer melt is cooled and solidifies into a polymer fibre. Such fibres typically are of great length, often kilometres.

A further object of the invention is to provide a method to provide a needled or cross-lapped cut pile fabric from a needled non-woven fabric comprising at least 50% by weight of kapok fibres.

Depending on the use of the non-woven fabric, it may be also done using low-melting fibres that can be fused. Such fabrics made by fusing the low melt fibres with the remaining fibres in the batt, can be needled to form loops with the loops remaining intact or cut. The fabric may also be cross-lapped, fair and/or needled only. A plurality of layers of non-woven staple fibres are typically lapped into a continuous web, which may be then needle punched to form a continuous batt. Suitable low melt natural fibres include those disclosed in WO2017192779.

The treatment after needling and/or cross-lapping may require addition of a bonding material or sizing, and usually is followed by a flexing step to make the fusion bonded batt more pliable and/or flexible. This step may include running through a compactor or over an edge to break up the bond of the fibres during or after cooling of the low melt fibres.

Another possibility is to employ a set of rotating wheels to work the surface of the batt to provide pliability to otherwise a stiff fabric. However, fabrics made by the subject method usually provides a fabric which is flexible, excellent appearance and can be readily sewn if the use of same requires such.

In a preferred embodiment of the present disclosure, kapok fiber nonwoven fabrics comprise kapok fibers in an amount of from 5% to 95% of those Kapok fibers on weight of the fabric, where the balance of the fabric weight is 95 to 5% of other natural or synthetic fibers, and where those fibers may be a single type of fiber or a blend of two or more fiber types. Certain embodiments of the bast fiber containing nonwoven fabrics of the invention, where the Kapok fibres have about 1-8, preferably 1 to 4 crimps per cm on average, demonstrating improved bulk and bulk stability over similar fabrics produced using Kapok fibres. It is a preferred embodiment of the present disclosure that the Kapok fibre nonwoven fabric may be produced by methods of forming that include drylaid, or airlaid, or wetlaid processing. It is known in the industry that the terms drylaid, airlaid or wetlaid, which may be rendered as dry-laid, air-laid or wet-laid, are broad in meaning and that each incorporates a variety of equipment, processes and means. The use of drylaid, airlaid, and wetlaid are not limiting and each do not define a single process for means of manufacturing.

Although the preferred embodiments of the invention have been described, it is contemplated that changes may be made without departing from the scope or spirit of the invention and it is desired that the invention be limited only by the scope of the claims. The following, non-limiting examples illustrate the subject invention.

Example 1: Various Yarn properties: A number of different yarns were produced according to the method of the subject invention. These are depicted in Table 1:

TABLE 1

Yarn Properties for binary bledns

| Composition (% weight/ weight) | | 80 BCI Cotton/ 20 Kapok | 80BCI Cotton/ 20 Kapok | 80BCI Cotton/ 20 Kapok | 80 Organic Cotton/ 20 Kapok | 80BCI Cotton/ 20 Kapok | 80 Organic Cotton/ 20 Kapok | 80 Organic Cotton/ 20 Kapok | 80BCI Cotton/ 20 Kapok | 80 Organic Cotton/ 20 Kapok | 80 Organic Cotton/ 20 Kapok | 80BCI Cotton/ 20 Kapok | 80BCI Cotton/ 20 Kapok |
|---|---|---|---|---|---|---|---|---|---|---|---|---|---|
| Spinning | | Compact | Compact | Siro | Ring | Siro | Ring | Siro | Compact Siro | Ring | Siro | Compact | Compact |
| Yarn Size (ASTM D6587) | | 8S | 16S | 21S | 21S | 32S | 32S | 32A | 40S | 40S | 40S | 40S | 60S |
| Weight | weight(even)-g/100 m | 7.314 | 3.515 | 2.757 | 2.726 | 1.795 | 1.84 | 3.629 | 1.428 | 1.485 | 2.917 | 1.440 | 0.936 |
| | weightCV (%) | 2.2 | 2.6 | 1.7 | 1.9 | 2.4 | 2.1 | 1.8 | 2.1 | 3.6 | 1.5 | 2.7 | 2.6 |
| | Regain (%) | 6.5 | 7.2 | 8.1 | 7.6 | 8.1 | 8.9 | 8.6 | 7.7 | 9.8 | 8.7 | 5.5 | 7.0 |
| Twist | twist(per 10 cm) | 44.9 | 63.5 | 69.3 | 70.7 | 87.1 | 85.1 | 43.0 | 98.6 | 90.8 | 58.6 | 107.5 | 127.9 |
| | unevenless of twist (%) | 4.5 | 3.1 | 2.2 | 11.7 | 3.1 | 4.4 | 5 | 4.1 | 6.5 | 4.3 | 4.1 | 2.6 |
| | twist factors | 383 | 384 | 366 | 373 | 371 | 363 | 260 | 377 | 347 | 317 | 411 | 399 |
| Single Yarn Strenght | single yarn strength CV (%) | 4.9 | 7.5 | 7.0 | 6.0 | 10.6 | 7.6 | 4.9 | 8.8 | 7.8 | 6.5 | 8.1 | 12.6 |
| | Elongation (%) | 7.8 | 6.5 | 6.4 | 6.4 | 5.5 | 6.7 | 6.6 | 5.5 | 5.4 | 7.1 | 4.5 | 3.9 |
| | Elongation CV (%) | 6.0 | 6.2 | 6.9 | 14.9 | 7.3 | 7.5 | 13.4 | 8.7 | 4.8 | 6.6 | 11.3 | 12.1 |

TABLE 1-continued

| Yarn Properties for binary bledns | | | | | | | | | | | | |
|---|---|---|---|---|---|---|---|---|---|---|---|---|
| Composition (% weight/ weight) | 80 BCI Cotton/ 20 Kapok | 80BCI Cotton/ 20 Kapok | 80BCI Cotton/ 20 Kapok | 80 Organic Cotton/ 20 Kapok | 80BCI Cotton/ 20 Kapok | 80 Organic Cotton/ 20 Kapok | 80 Organic Cotton/ 20 Kapok | 80BCI Cotton/ 20 Kapok | 80 Organic Cotton/ 20 Kapok | 80 Organic Cotton/ 20 Kapok | 80BCI Cotton/ 20 Kapok | 80BCI Cotton/ 20 Kapok |
| breaking strength(CN/ tex) | 17.7 | 15.7 | 16.5 | 16.1 | 15.7 | 16.1 | 14.3 | 15.3 | 14.4 | 13.7 | 15.1 | 13.6 |

The yarn properties in Table 1 show the usefulness and good properties obtained from various yarns obtained from kapok fibre blends according to the invention, for various garments and otherwise shaped articles. It shows that the subject invention permits the use of the spinnable and/or needable Kapok fibre fraction, and/or Kapok fibre blend with one or more other fibres in a range of from 100% to 15% by weight for the preparation of yarns, woven and non-woven fabrics or insulation materials.

Unless otherwise expressly stated in the claims, it is in no way intended that any process or method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

The invention claimed is:

1. A process comprising the steps of:

a) sorting kapok fibres and/or a kapok-fibre blend with one or more other fibres in a range of from 100% to 5% by weight for spinning, which comprises volatizing opened and unsorted kapok fibres and/or opened and unsorted kapok-fibre blend by subjecting them to an air stream, whereby the fibre-containing air stream is directed towards a deposition area comprising a sorting wall, whereby fibres of different lengths are deposited in the deposition area and/or against the sorting wall at a position commensurate with their length, weight and the resulting respective flight time, whereby a longer fibre fraction is collected behind the sorting wall, to obtain a short staple kapok fibre base and/or kapok-fibre blend base having an average length of at least 10 mm; and b) adjusting the average moisture content of the kapok fibre base and/or kapok-fibre blend base to an average measured moisture content in the range of from 8% to 12% moisture, to obtain moisture- and length-adjusted kapok fibres and/or moisture- and length-adjusted kapok-fibre blend.

2. The process according to claim 1, wherein the sorting wall is based at an angle essentially perpendicular to the air stream.

3. The process according to claim 1, further comprising the steps of:

teasing and/or carding the moisture- and length-adjusted kapok fibres, or the moisture- and length-adjusted kapok-comprising fibre blend, to obtain kapok-comprising carded fibres; and spinning the carded fibres, or roving the carded fibres and spinning the rovings, into a yarn.

4. The process according to claim 3, wherein spinning includes one or more of: core-spun spinning; vortex spinning; wool spinning; worsted spinning; ring spinning; open end spinning; multi-component spinning; siro spinning; compact spinning; friction twisting;

self-twist spinning; electrostatic spinning; and twistless spinning.

5. The process according to claim 3, wherein a yarn is obtained having a Cotton Count (Ne) of from 6s to 60s.

6. The process according to claim 5, wherein the content of kapok fibres in yarns with a cotton count ranging of from 6s to 21s (Ne) is at least 20%.

7. The process according to claim 6, wherein the content of kapok fibres for ring spun, siro-compact, and/or core spun yarns is above 18%, and for open end spun yarns is above 31%.

8. The process according to claim 6, wherein the content of kapok fibres in yams with a cotton count ranging of from 6s to 21s (Ne) is at least 30%.

9. The process according to claim 5, wherein the content of kapok fibres in yarns with a cotton count ranging of from 23s to 60s (Ne) is in the range of from 10% to 30%.

10. The process according to claim 9, wherein the content of kapok fibres for ring spun, siro-compact, and/or core spun yarns is above 15%, and for open end spun yarns is above 30%.

11. The process according to claim 5, wherein the content of kapok fibres in yarns with a cotton count ranging of from 35s to 60s (Ne) is in the range of from 15% to 25%.

12. The process according to claim 5, further comprising a step to convert the yarn into a woven or non-woven fabric.

13. The process according to claim 3, further comprising sizing the yarn with a sizing agent.

14. The process according to claim 13, wherein the sizing agent comprises a wax.

15. The process according to claim 14, wherein the sizing comprises contacting the yam with a solid natural wax.

16. The process according to claim 1, further comprising:

drafting a roving of the moisture- and length-adjusted kapok-comprising fibre blend to a thinner fibre strand; and winding the strand, or twisting the strand to provide a twisted strand and winding the twisted strand, as a yarn to a wound yarn bobbin.

17. The process according to claim 16, further comprising sizing the twisted strand with a sizing agent.

18. The process according to claim 17, wherein the sizing comprises contacting the twisted strand with a solid natural wax.

19. The process according to claim 17, wherein the sizing agent comprises a wax.

20. The process according to claim 1, wherein the one or more other fibres comprise i) one or more of treated or untreated naturally occurring fibres, ii) one or more synthetic fibres, or iii) one or more synthetic fibres obtained by extrusion spinning, wet spinning, and/or melt spinning.

21. The process according to claim 1, wherein the one or more naturally occurring fibres are obtained from animal sources, silk threads from silkworms, or from plant sources.

22. The process according to claim 21, wherein the animal sources comprise wool from sheep, goat, alpaca, and/or rabbit; or the plant sources comprise cotton, flax, hemp, jute, sisal, or milkweed.

23. The process according to claim 21, wherein the one or more naturally occurring fibres are present in an amount of from 0 to 85% by weight.

24. The process according to claim 1, wherein the one or more synthetic fibres include polyamides, nylon; polyacrylic fibres, polyolefinic fibres and/or polyester fibres;

cellulosic fibres: rayon; or lyocell.

25. The process according to claim 24, wherein the polyester fibres comprise aliphatic, semi-aromatic or aromatic polyester materials as virgin materials, recycled materials, or combinations thereof.

26. The process according to claim 24, wherein the one or more synthetic fibres are present in an amount of from 0 to 85% by weight.

27. The process according to claim 1, further comprising a step to convert the moisture- and length-adjusted kapok fibres, or the moisture- and length-adjusted kapok-comprising fibre blend into a batt, needling the batt of fibres, and subjecting the needled batt of fibres with a suitable sizing, and/or placing the needled batt of fibres into a scrim.

28. The process according to claim 27, further comprising adding low melt fusible fibres to the moisture- and length-adjusted kapok fibres or the moisture- and length-adjusted kapok-comprising fibre blend, forming the resulting blend into a batt, needling the batt of blended fibres, subjecting the needled batt of fibres to a temperature above the melting temperature of the low melt fusible fibres for a period of time sufficient to form a cohesive composite non-woven fabric, and treating the composite non-woven fabric during a cooling down step to provide flexibility.

29. The process according to claim 1, further comprising a step to convert the moisture- and length-adjusted kapok fibres, or the moisture- and length-adjusted kapok-comprising fibre blend into a batt, cross-lapping (layering) the batt of fibres and subjecting the cross-lapped batt of fibres with a suitable sizing, and/or placing the cross-lapped batt of fibres into a scrim.

30. The process of claim 1, further comprising blending the moisture-and length-adjusted kapok fibres or the moisture- and length-adjusted kapok-comprising fibre blend with a second or further fibre base, to obtain a kapok-comprising fibre blend.

* * * * *